US005253379A

United States Patent [19]

Dusamos et al.

[11] Patent Number: 5,253,379

[45] Date of Patent: Oct. 19, 1993

[54] WASHING PROCESS

[75] Inventors: Marcellus G. Dusamos; Stefan E. Frick, both of Maarssen; Wilhelmus K. Van der Kinderen, Wilnis; Wijnand Ploeg, Maarssen, all of Netherlands

[73] Assignee: Unilever Patent Holdings B.V., Vlaardingen, Netherlands

[21] Appl. No.: 871,167

[22] Filed: Apr. 20, 1992

[30] Foreign Application Priority Data

Apr. 19, 1991 [GB] United Kingdom ..... 9108387

[51] Int. Cl.[5] ..... D06F 39/02

[52] U.S. Cl. ..... 8/158; 68/12.18; 137/5; 137/93

[58] Field of Search ..... 8/158; 68/12.18, 17 R; 137/5, 93

[56] References Cited

U.S. PATENT DOCUMENTS 3,223,108 12/1965 Martz, Jr. ..... 68/17 R X
3,645,669 2/1972 Rausch ..... 68/17 R X
4,211,517 7/1980 Schmid ..... 137/93 X

FOREIGN PATENT DOCUMENTS 2217050 10/1989 United Kingdom ..... 68/17 R

*Primary Examiner*—Philip R. Coe
*Attorney, Agent, or Firm*—Cushman, Darby & Cushman

[57] ABSTRACT

Washing process in an industrial washing machine, whereby a property of the wash liquor is measured which is dependent on the concentration of detergent product therein, and detergent product is added to the wash liquor, dependent on the property, characterized in that the wash cycle comprises a first period ($t_1$) in which product is added during a fixed time period to obtain a high concentration in the wash liquor or until the measured property reaches a high set point where it is maintained by gradually adding detergent product, and a second period ($t_2$) in which the property is kept at a low set point. There is also provided a device for controlling the dosing of detergent product to the process.

4 Claims, 1 Drawing Sheet

WASHING PROCESS

Figure 1:
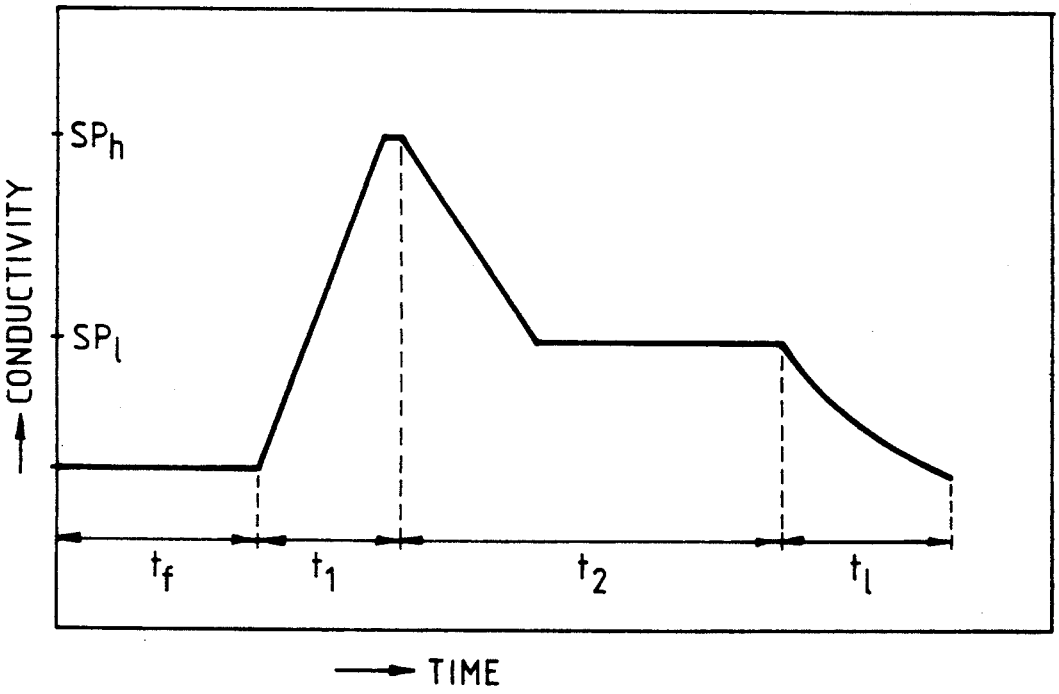

The present invention relates to a washing process and to a device for controlling the dosing of detergent product in said process. More in particular, it relates to an industrial washing process in which a wash load is treated with a detergent product in a tunnel washing machine. Such machines are widely used for industrial fabric washing.

In the washing process of the above mentioned kind the soiled load is gradually moved from one end of the tunnel to the other end, and thereby it is contacted with a wash liquor which is an aqueous dilution of a detergent product. It is important that the concentration of the detergent product in the wash liquor is sufficiently high to achieve a good cleaning result. On the other hand, overdosing of detergent product should be avoided for cost reasons.

A number of different methods have been described for controlling the dosing of detergent product in tunnel washing machines. For example, it is known to continuously measure the conductivity of the wash liquor by means of electrodes, and to maintain the conductivity at a pre-set level by controlled addition of detergent product. It is thereby assumed that the conductivity of the wash liquor is completely determined by the amount of the detergent product. However, certain types of soil such as urin are known to contribute to the conductivity, so that this assumption is not always warranted. Furthermore, the dosing time of the detergent product is often too long when using conductivity control, due to poor mixing near the electrodes. As a consequence, an overdosing of detergent product may occur resulting in a far from optimal use of the detergent product.

It is also possible to simply add a fixed amount of detergent product in every wash cycle, or a constant amount per unit of time. These methods are not very effective in providing a constant washing result, particularly in case of unstable process conditions such as fluctuating water pressure, wash load or pump delivery rate.

It is an object of the present invention to provide an improved washing process. It is a further object to provide a device for controlling the process.

We have now found that one or more of these objects may be achieved by the process of the invention for washing in an industrial washing machine, whereby a property of the wash liquor is measured which is dependent on the concentration of detergent product therein, and detergent product is added to the wash liquor, dependent on said property. The process of the invention is characterized in that the wash cycle comprises a first period ($t_1$) in which product is added during a fixed time period to obtain a high concentration in the wash liquor or until the measured property reaches a high set point where it is maintained by gradually adding detergent product, and a second period ($t_2$) in which said property is kept at a low set point.

During the first period ($t_1$) the detergent product is preferably added until the measured property reaches a high set point where it is maintained during at most 4 seconds by gradually adding detergent product. The first time period ($t_1$) preferably comprises 8–20% of the total wash cycle time, whereas the second time period ($t_2$) effectively comprises 45–80% of the total wash cycle time. It will be understood that the length of the first time period is related to the dosing rate of detergent product during that period and the height of the higher set point ($sp_h$).

It is desirable that during the first time period ($t_1$) 75–99%by weight and during the second time period ($t_2$) 1–25% by weight of the total detergent product to be used is added into the washing machine.

Preferably, the wash cycle comprises a lag period ($t_f$) preceding the first period, in which no detergent product is added. The lag period ($t_f$) preferably comprises 4–10% of the total wash cycle time.

It is especially preferred that the wash cycle comprises a last period ($t_l$) after the second period, in which no detergent product is added. This last period preferably comprises 8–25% of the total wash cycle time.

The measured property of the wash liquor is preferably the electrical conductivity.

According to another aspect of the invention, there is provided a device for controlling the dosing of detergent product to the above process.

The invention will now be further explained by means of the accompanying drawing, in which FIG. 1 depicts the conductivity versus time profile in an industrial tunnel washer during one complete wash cycle, whereby the process of the invention is carried out.

The figure relates to a process whereby the conductivity is measured as the relevant property of the wash liquor. It will be understood, however, that instead of or in addition to the conductivity also other properties may be measured such as the pH, the redox potential or the presence of one or more specific chemical compounds such as for example peracetic acid.

Instead of keeping the conductivity of the wash liquor constant over the entire wash cycle, the process of the invention provides a first period ($t_1$) in which detergent product is added until the measured conductivity reaches a high set point ($sp_h$). Subsequently, the conductivity is kept at the high set point for a short period of time by addition of small amounts of further detergent product. During this first period the concentration of detergent product in the wash liquor is higher than strictly necessary, but this has a beneficial effect on the cleaning process.

After the first period, the addition of detergent product is stopped and the conductivity begins to drop. As soon as the conductivity of the wash liquor reaches the lower set point ($sp_l$), the conductivity is again kept constant at that level by controlled addition of detergent product. This is continued during the second period ($t_2$). The end of this second period may coincide with the end of the wash cycle, but preferably it ends somewhat earlier. In that case the addition of detergent product is stopped and the conductivity is allowed to drop below the lower set point ($sp_l$) during the remainder of the wash cycle, the period ($t_l$). This saves detergent product which would otherwise not have any significant effect on the cleaning process.

In the depicted situation, the wash cycle begins with a lag period ($t_f$) in which no detergent product is added. This again saves detergent product which would otherwise have a negligable effect on the whole of the washing process.

The process of the invention makes it possible to control the addition of detergent product to the wash liquor in such a way that optimal cleaning results are obtained. The overdosing during the first period ($t_1$) proved to be especially effective in obtaining an optimal, economical use of detergent product.

The choice of the set points $sp_l$ and $sp_h$ can suitably be made as follows. First, the washing process is carried out in the conventional way, maintaining the conductivity at a suitable average level during the whole wash cycle. This average level is dependent on a number of factors such as degree of soiling, type of fabrics, etc. It can be easily determined by means of experiments.

A value of about 20–70%, preferably 40–60% of this average conductivity level is then set to be the lower set point ($sp_l$). Subsequently, a higher set point ($sp_h$) is chosen which corresponds to a conductivity level being at least 10%, but preferably 25%, or even 50% or more above the average level when carrying out the washing process in the conventional way.

The present invention also provides a device for controlling the dosing of detergent product to the above described process. The device suitably comprises one or more inputs for measuring a property of the wash liquor, for example the conductivity, one or more outputs for actuating some dosing equipment for the detergent product, a number of timers and a microcomputer capable of storing and executing a program.

The invention is further illustrated by the following non-limiting examples, by which the positive effects of a "peak-dosage" followed by a considerably lower dosage applied during an industrial washing process are clearly shown.

EXAMPLE 1, A

Several test fabrics were treated in a Senking tunnel-type p19–20 industrial washing machine having a wash cycle time of 118 seconds, and washing efficiencies were measured . The used test fabrics are AS8 (street soil), Kwyove (fatty soil), and Vekoprop (chocolate milk).

More information on these test fabrics can be found in memo 84021-H from I. R. TNO,Delft, Netherlands ( with regard to Kwyove and Vekoprop) and product information dated February 1991 from Centre for Testmaterials, Vlaardingen, Netherlands (with regard to AS8).

The experiments for example 1 were carried out according to the process of the present invention including a "peak-dosage" of detergent product. The "peak dosage" was applied 5 seconds after the start of the wash cycle. During the "peak dosage" time period which lasted 18 seconds 97% by weight of the total detergent product used was dosed into the washing machine; the rest was subsequently added during time period ($t_2$) of 70 seconds.

On the other hand, during the experiments for comparative example A an average dosage rate of detergent product over the complete wash cycle was applied. Fot both types of experiments, an equal total quantity of detergent product of 750 ml was used.

The following equation was used for determining the washing efficiencies:

$$\text{washing efficiency (\%)} = \frac{R_w - R_g}{R_o - R_g} * 100\%$$

wherein:

$R_g$ = reflection of the soiled fabric (using 460 nm light)

$R_w$ = reflection of the washed fabric (using 460 nm light)

$R_o$ = reflection of clean/unsoiled fabric (using 460 nm light), whereby: $R_o$ = 86

$R_g$ (*AS8*) = 40.0

$R_g$ (*Kwyove*) = 4.0

$R_g$ (*Vekoprop*) = 30.4

Using this washing efficiency equation, the following wash efficiency results were obtained:

| Test fabric | Example 1 | Example A |
|---|---|---|
| AS8 | 74.1 ± 1.8% | 69.8 ± 1.8% |
| Kwyove | 76.2 ± 2.9% | 69.1 ± 2.9% |
| Vekoprop | 84.4 ± 2.3% | 79.1 ± 2.3% |

It can be seen that the washing process according to the invention resulted in significantle better washing efficiencies than the comparative process wherein an average dosage rate of detergent product was applied.

We claim:

1. Washing process in an industrial washing machine, which comprises contacting a solid load during a wash cycle with a wash liquid which is an aqueous dilution of a detergent product, measuring a property of the wash liquor which is dependent on concentration of detergent product therein, and adding detergent product to the wash liquor, dependent on said property, and wherein the wash cycle comprises a first period ($t_1$) in which detergent product is added during a fixed time period to obtain a high concentration in the wash liquor or until the measured property reaches a high set point where it is maintained by gradually adding detergent product, and a second period ($t_2$) in which said property is kept at a low set point.

2. Process according to claim 1, characterized in that the wash cycle comprises a lag period ($t_l$) preceding the first period ($t_1$), in which no detergent product is added.

3. Process according to claim 1, characterized in that the wash cycle comprises a last period after the second period ($t_l$), in which no detergent product is added.

4. Process according to claim 1, characterized in that the measured property of the wash liquor is the electrical conductivity.

* * * * *